United States Patent [19]

Küker et al.

[11] Patent Number: 4,802,417

[45] Date of Patent: Feb. 7, 1989

[54] GANGWAY FOR A RAILWAY CAR PASSAGEWAY

[75] Inventors: Wolfgang Küker, Salzgitter; Peter Braemert, Wolfenbüttel; Werner Ortmann, Minden, all of Fed. Rep. of Germany

[73] Assignee: Linke-Hofmann-Busch GmbH, Fed. Rep. of Germany

[21] Appl. No.: 73,016

[22] Filed: Jul. 14, 1987

[30] Foreign Application Priority Data

Aug. 22, 1986 [DE] Fed. Rep. of Germany ..... 3628627

[51] Int. Cl.[4] ..... B61D 17/00; B61D 17/14; B60D 5/00

[52] U.S. Cl. ..... 105/8.1; 280/403

[58] Field of Search ..... 105/8.1, 425, 458, 460; 280/403

[56] References Cited

U.S. PATENT DOCUMENTS

| | | | |
|---|---|---|---|
| 1,449,403 | 3/1923 | Hedley et al. | 105/458 |
| 3,137,514 | 6/1964 | Wahl | 105/8.1 |
| 3,370,552 | 2/1968 | De Podesta et al. | 105/458 |
| 3,572,254 | 3/1971 | Slager | 105/458 |
| 3,754,515 | 8/1973 | Van Der Sluys et al. | 105/458 |
| 4,421,339 | 12/1983 | Hagin | 280/403 |
| 4,667,604 | 5/1987 | Baker | 105/458 |

FOREIGN PATENT DOCUMENTS

| | | | |
|---|---|---|---|
| 539581 | 11/1931 | Fed. Rep. of Germany | 105/458 |
| 640970 | 6/1937 | Fed. Rep. of Germany . | |
| 3305062 | 6/1984 | Fed. Rep. of Germany . | |
| 110095 | 11/1964 | Netherlands | 280/403 |

*Primary Examiner*—Ronald C. Capossela
*Attorney, Agent, or Firm*—McGlew and Tuttle

[57] ABSTRACT

A gangway is provided between two railway cars or units of railway cars that are pivoted to one another, and that forms a continuous, stepless passage for all travel motions. The entire gangway is designed as a unit that is held in the central position to each of the ends of the cars facing one another with the ability to shift lengthwise, by a centering device, and is supported and guided on bridge bearings, and is mounted to be able to pivot around its vertical axis and also to be able to tip out of the horizontal plane. The bridge area of the gangway consists of a number of rigid rails placed parallel to one another at prescribed distances and able to move lengthwise, which are enclosed and guided at both ends in supporting profiles that are mounted and guided on the bridge bearings associated with them.

20 Claims, 4 Drawing Sheets

GANGWAY FOR A RAILWAY CAR PASSAGEWAY

FIELD AND BACKGROUND OF THE INVENTION

The present invention relates in general to gangways for rail vehicles, and in particular to a new and useful gangway which can compensate for pivotal and lengthwise movements between the adjacent ends of a pair of railway cars.

Passengers as well as train personnel in railway cars should be able to pass between the car units of a train even during the trip. To make this passage possible, passageways are located between the car units that ordinarily consist of a passable gangway and a vestibule surrounding it, for example a gangway bellows.

The relative motions occurring between the ends of the cars that face each other during operation, must not be obstructed either by the vestibule or by the gangway. In particular, the passageway must be able to compensate for the wobbling motions, the pitching motions, lateral and vertical motions, and motions in the longitudinal direction of the car, between the ends of the car units, with the passability of the passageway being guaranteed under normal operating conditions.

A passageway is disclosed by German Patent No. 640,970 that consists of two floor plates, that are placed to pivot around a horizontal axis at each end of the car at floor level, and with the floor plates overlapping in the position of use. In these known gangways, the narrow cross section of the gangway which is present between the bumpers is severely restricted in case of relative motions between the ends of the cars. In the same way, the gangway can only partly compensate for possible relative motions between the ends of the cars, with large relative motions also occurring at the overlapping edges. Rather great unevenness or steps, or even open gaps can form.

The two-part gangway for passage between two railway cars or units pivoted to one another described in German patent application disclosure No. 33 05 062 has a number of essentially rigid rails extending parallel to one another that are flexibly connected to one another at prescribed distances. Each of the two halves of a bridge are connected rigidly at one end to a car unit, and at the other end, i.e. in the center of the passageway, they are connected rigidly to one another, with the rails being supported vertically at their end areas to pivot on supporting rods running in the longitudinal direction of the car and secured against lateral motions and motions in the direction of their longitudinal axis.

Because the gangway has to absorb all relative motions itself, costly construction cannot be avoided, and in particular the rigid linking of the halves of the bridge to the ends of the cars facing one another also proves to be a drawback.

gangway pursuant to a German supplementary patent application German application disclosure No. 34 01 298) enlarging on the aforementioned application also does not avoid the drawbacks mentioned, but essentially changes only the design of the rails.

SUMMARY OF THE INVENTION

It is therefore the basic purpose of this invention to further develop a gangway of this type so that the gangway is relieved of unsuitable deformation and adaption capability, and meets the requirements of safe and convenient passage while traveling, at reasonable expense.

Accordingly a object of the present invention is to provide a gangway for empty space between adjacent ends of two railway cars, which comprises a plurality of rigid rails which are mounted to extend substantially parallel to each other and at spaced positions from each other, said rails being slidably mounted with respect to each other, pairs of bearings on each of the ends of the railway cars and guidemeans mounted on the bearings for pivoting and for lengthwise movement, the rails being mounted across the guidemeans for carrying the rails.

A further object of the present invention is to provide a gangway which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
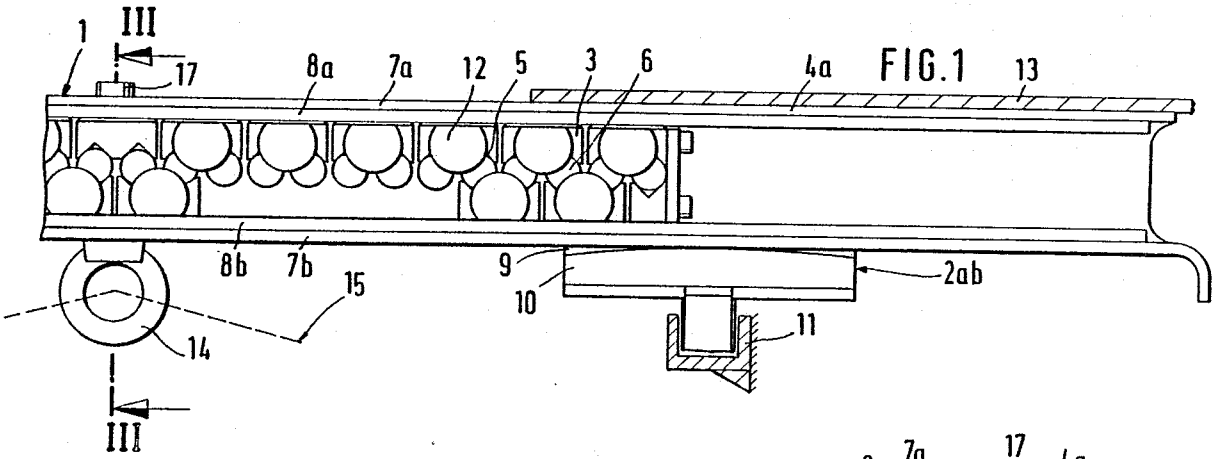
FIG. 1 is a side view of a gangway in partial cross section and partly broken away.
Figure 3:
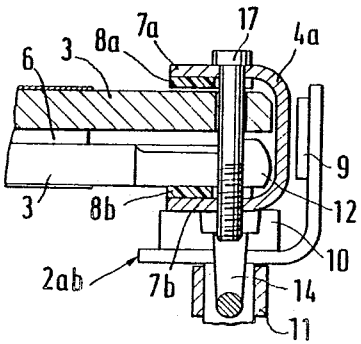
FIG. 3 is a section taken along the line III—III of FIG. 1, partly broken away.
Figure 2:
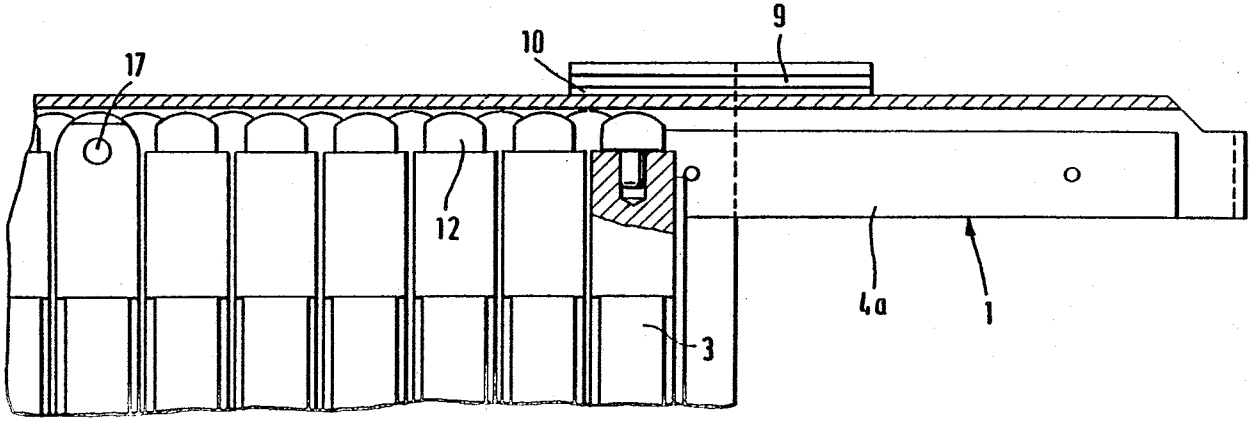
FIG. 2 is a top view of a gangway in partial cross section and partly broken away, without the bridge connecting plate.

Refering to the drawings in particular, the invention embodied in FIGS. 1 through 3 comprises a gangway generally designated 1 which is mounted between adjacent ends of a pair of rail vehicles, and which comprises a plurality of essentially rigid, parallel and slightly spaced rails 3 which extend substantially transversly to the longitudinal direction of the railway cars, and which are carried by guidemeans that are supported on bearings connected to the railway cars.

The gangway 1 pursuant to the invention is supported at each of the ends of two cars that are facing one another, on bridge bearings **2*ab* and is guided to move lengthwise, with the possibility both of pivoting around a vertical axis and of leaving or tipping out of the horizontal plane. As a bridge area, the gangway 1 has a number of rails 3 with their long faces preferably perpendicular to the longitudinal direction of the car, each of which is guided and held at its ends by supporting profiles 4*a* and 4*b*. The individual rails 3 are essentially rigid and are placed parallel to one another at prescribed distances and with the ability to move lengthwise. The rails 3 are mutually braced by special design and arrangement, with at least one of the rails 3 being locked at the ends to the associated supporting profile 4***a* or 4*b*, and able to pivot in the plane formed by the supporting profiles 4*a* and 4*b*.

In the example described further, according to FIG. 1–3, the rails 3 of the bridge area are arranged in two layers, with the lower layer preferably being displaced from the upper layer by a definite profile width. In this case, half of the rails 3 at the ends of the bridge area are additionally braced in the bridge area. The rails 3 of the two layers have recesses 5 on their surfaces facing one another to hold sliders 6. The recesses 5 beneficially extend in the long direction of the rails 3 and hold sliders 6, for example round bars of slippery plastic. The individual rails 3 can move easily relative to one another and are kept at predetermined distances by the design and arrangement of the recesses 5 and the sliders 6.

The two supporting profiles 4*a* and 4*b* are preferably designed as U-shaped channels and enclose the two ends of the rails 3. An upper or lower slip ledge 8*a* or 8*b* is attached between the upper or lower side bar 7*a* or 7*b* of the supporting profile 4*a* or 4*b* and each of the rails 3. To minimize the wear of the ends of the rails 3 on the particular contact surfaces of the supporting profile 4*a* or 4*b*, rounded wear bumpers 12 can be attached to the ends of the rails. The supporting profiles 4*a* and 4*b* are supported on the ends of the cars facing one another on their particular associated bridge bearings 2*aa* and 2*ab* or 2*ba* and 2*bb*.

At least one of the rails 3 of the bridge area is locked at each end to the associated supporting profiles 4*a* or 4*b*, by means of a pivot 17, and can thus pivot in the plane spanned by the supporting profiles 4*a* and 4*b*.

Each bridge bearing 2*aa*, 2*ab*, 2*ba* and 2*bb* has a vertical guide 9 and a horizontal guide 10, with the horizontal guide 10 being crowned at least in the longitudinal direction of the car, starting from the support point or the support surface. In addition, each bridge bearing 2*aa*, 2*ab*, 2*ba*, and 2*bb* can rotate around a vertical axis and is supported in a bearing block 11 on the car side.

There are bridge endplates pivoted to the ends of the cars in the floor area 13 in each car, that rest on the ends of the gangway 1 and overlap them in every travel situation.

A fastener 14 is provided in the center of the gangway 1, with which a centering device 15 (not shown in detail) is engaged, which keeps the gangway 1, that is freely movable lengthwise within the framework of the maximum necessary shifting motions, in the central position between the ends of the cars.

The centering device 15 can consist of spring elements 16, which in turn are engaged in the center of the gangway 1, on the one hand, and at the associated ends of the cars, on the other hand.

The entire gangway 1 is thus held at a distance from the ends of the cars facing one another with the ability to shift lengthwise in the central position, with the gangway 1 being supported and guided at the car end, on the bridge bearings 2*aa*, 2*ab*, 2*ba*, and 2*bb*. The design and arrangement of the bridge bearings 2*aa*, 2*ab*, 2*ba*, and 2*bb* permits the gangway 1 both to pivot in the plane spanned by the supporting profile 4*a* and 4*b* and to tip out of the plane of the floors of the cars, at least in the longitudinal direction of the cars.

FIGS. 4–7 show the pivoting of the gangway in selected pivoted positions occurring during travel.

Figure 4:
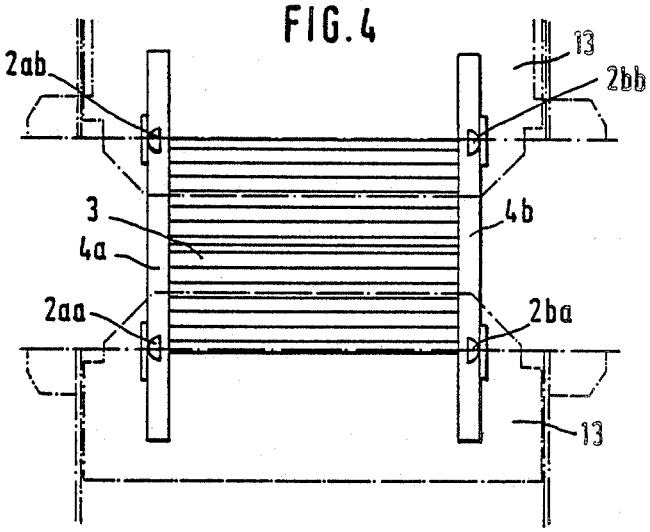
FIG. 4 is a top view of the gangway between the ends of two cars in the straight-line position.

In the straight-line travel condition according to FIG. 4, the rails 3 are positioned perpendicular to the longitudinal direction of the car, and the supporting profiles 4*a* and 4*b* point in the longitudinal direction of the car. With a change of separation between two cars, there is a sliding motion of the supporting profiles 4*a* and 4*b* on the bridge bearings 2*aa* and 2*ab* or 2*ba* and 2*bb*. For this purpose, on the one hand, the supporting profiles 4*a* and 4*b* are appropriately long to provide for secure support on the bridge bearing 2*aa* to 2*bb* for all stretching motions of the suspension, and on the other hand, sufficient clearance is provided at the end of the cars in the area of the gangway 1 to contain it in a compression motion.

Figure 5:
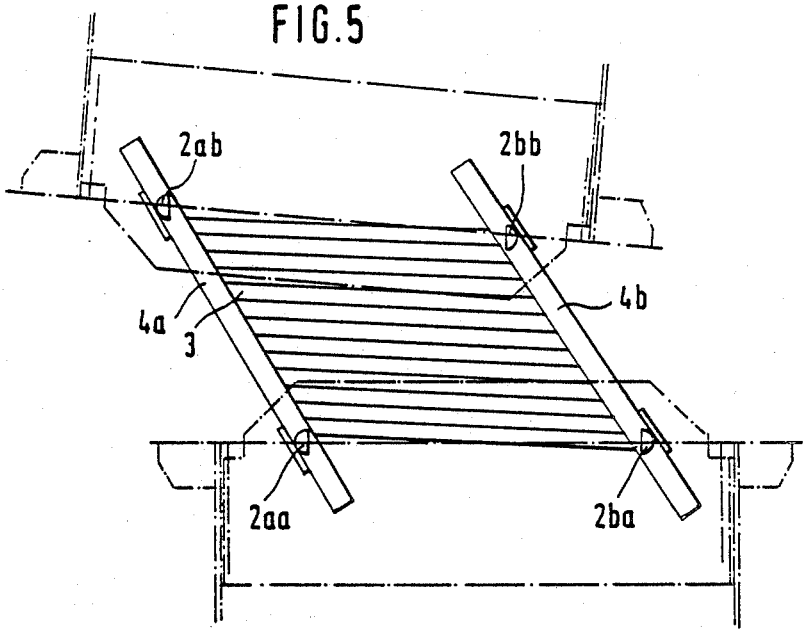
FIG. 5 is a top view of the gangway between the ends of two cars that are pivoted when entering a 150 m curve.
Figure 6:
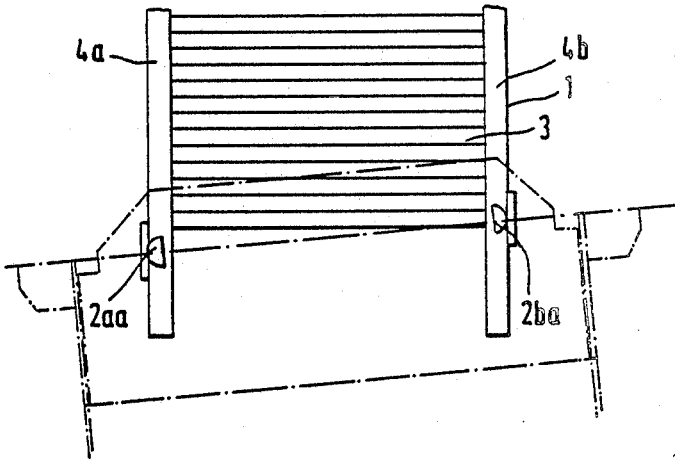
FIG. 6 is a top view of the gangway between the ends of two cars that are pivoted when traversing a 150 m curve.

FIG. 5 shows the pivoting of the gangway when entering a 150 m curve. The supporting profiles 4*a* and 4*b* pivot in parallel, while the rails 3 arrive at an angle to the direction across the car. Within a 150 m curve, the gangway 1 comes to the situation of FIG. 6, with the rails 3 oriented perpendicular to the supporting profiles 4*a* and 4*b*.

Figure 7:
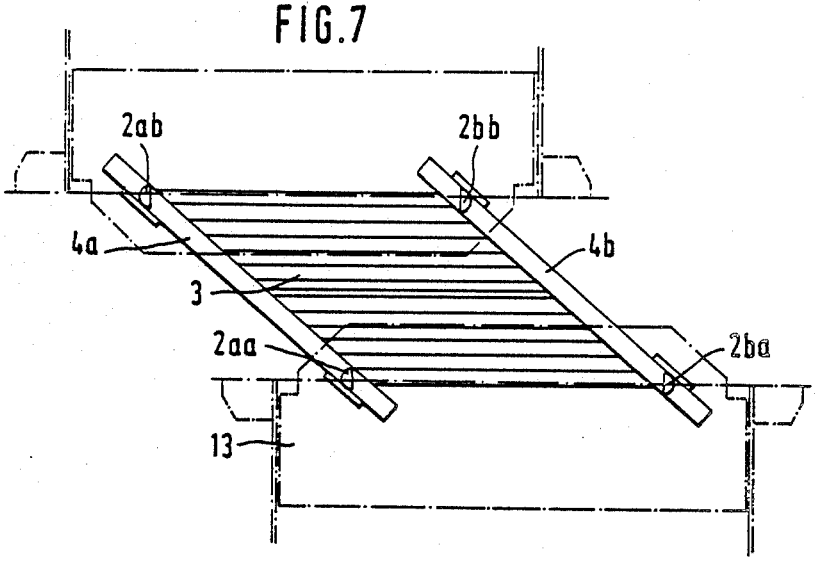
FIG. 7 is a top view of the gangway between the ends of two cars that are pivoted when traversing a 150 m S-curve.

FIG. 7 shows the pivoting of the gangway when traversing a 150 m S-curve. The ends of the cars in this case are displaced laterally to the extreme, so that the supporting profiles 4*a* and 4*b* are severely pivoted and the vertical guides 9 have to absorb large lateral guidance forces especially in this pivoted position.

With a difference in height between two cars, the gangway will arrange itself in the necessary tilted position out of the horizontal plane unrestrained, because of the crowned horizontal guide 10.

Thus, the gangway 1 forms a continuous, stepless passage between two coupled cars for all travel motions, with its possible motions orienting themselves to the deformability of a flexible vestibule.

While a specific embodiment of the invention has been shown and described in detail to illustrate the application of the principles of the invention, it will be understood that the invention may be embodied otherwise without departing from such principles.

What is claimed is:

1. A gangway for spanning a space between adjacent ends of two railway cars, comprising: a plurality of substantially rigid-parallel and spaced apart rails forming a bridge area in the space; bridge bearings connected to the end of each railway car, each said bridge bearing being pivotable with respect to the end of a railway car for pivotal movement about an axis; guide means for supporting said rails for sliding with respect to each other, said guide means being mounted on said bridge bearings for pivoting therewith and for lengthwise movement with respect to said bridge bearings.

2. A gangway according to claim 1 wherein said guide means comprise a pair of spaced apart supporting profiles engaged on said bridge bearings, said rails extending between and being supported on said supporting profiles.

3. A gangway according to claim 2 wherein each supporting profile has opposite end areas, said opposite end areas of each supporting profile being engaged on one bridge bearing for pivoting and lengthwise sliding on said bridge bearing.

4. A gangway according to claim 3 wherein each bridge bearing includes a horizontal guide on which one of said supporting profiles is engaged, and a verticle guide connected to said horizontal guide engageable against a side of one of said supporting profiles.

5. A gangway according to claim 4 wherein each horizontal guide of each bridge bearing is crowned at least in a lengthwise direction of the railway cars.

6. A gangway according to claim 2 wherein each of said supporting profiles comprises a U-shaped channel, open ends of said U-shaped channels facing each other and receiving opposite said ends of said rails.

7. A gangway according to claim 6 where each U-shaped channel includes upper and lower side bars, and slip ledges connected between said upper and lower side bars and each rail.

8. A gangway according to claim 2 including pivots extending in a horizontal direction for pivotally connecting at least one rail to said supporting profiles.

9. A gangway according to claim 1 wherein each bridge bearing is mounted for pivotal movement about a horizontal axis to a respective railway car.

10. A gangway according to claim 1 including sliders slidably mounted between adjacent rails in said bridge area.

11. A gangway according to claim 10 wherein each of said sliders comprises round bars made of slippery plastic material engaged in facing recesses of adjacent rails.

12. A gangway according to claim 10 including upper and lower layers of said rails, each rail of said upper layer being slidably engaged to an adjacent rail of said lower layer by sliders for constraining relative movement between adjacent rails substantially to linear sliding movement there between.

13. A gangway according to claim 1 including centering means connected between a center of said guide means and each of the railway cars for maintaining centering of guide means in said space between the railway cars, said centering means permitting longitudinal movement between said guide means and the railway cars.

14. A gangway according to claim 13 wherein said centering means comprises a bridge connector plate connected to said guide means and being connected resiliently to each end of the railway cars.

15. A gangway according to claim 14 wherein said bridge connector plate retains said guide means and said bridge area from lifting off said bridge bearings.

16. A gangway for passageways between two railway cars having ends that are pivoted to one another, comprising a bridge area having a plurality of essentially rigid rails that are parallel to one another and spaced at prescribed distances from one another, said rails being movably relative to one another, guide elements to which said rails are engaged for guiding said rails relative to the ends of the cars, and bridge bearings pivotally connected to ends of respective railway cars and connected to said guide elements said guide elements being movable lengthwise with respect to the bridge bearing.

17. A method of bridging the space between adjacent ends of railway cars comprising providing pivotable bridge bearings on each of the railway car ends, extending a pair of supporting profiles between the ends of the railway cars on the bridging bearings to permit lengthwise with respect to the bridge bearings and pivotal movement with the bridge bearings, and extending a plurality of parallel and spaced rails between said supporting profiles to form a bridge area between the railway car ends, said rails being slidable with respect to each other with pivoting of said supporting profiles.

18. A method according to claim 17 including resiliently connecting a center of each supporting profile to each railway car end for maintaining a centering of the supporting profiles and the bridge area.

19. A method according to claim 18 including providing sliders between adjacent rails for constraining relative movement between said rails substantially to sliding movement.

20. A method according to claim 19 including arranging the rails in two layers of rails, one above the other.

* * * * *